US010807833B2

(12) United States Patent
Weibel et al.

(10) Patent No.: US 10,807,833 B2
(45) Date of Patent: Oct. 20, 2020

(54) METHOD FOR ERECTING AN ELEVATOR SYSTEM, AND ELEVATOR SYSTEM WHICH CAN BE ADAPTED TO AN INCREASING BUILDING HEIGHT

(71) Applicant: Inventio AG, Hergiswil (CH)

(72) Inventors: Andre Weibel, Ballwil (CH); Lukas Christen, Glattpark/Opfikon (CH)

(73) Assignee: INVENTIO AG, Hergiswil NW (CH)

( * ) Notice: Subject to any disclaimer, the term of this patent is extended or adjusted under 35 U.S.C. 154(b) by 313 days.

(21) Appl. No.: 15/781,502

(22) PCT Filed: Dec. 13, 2016

(86) PCT No.: PCT/EP2016/080727
§ 371 (c)(1),
(2) Date: Jun. 5, 2018

(87) PCT Pub. No.: WO2017/102684
PCT Pub. Date: Jun. 22, 2017

(65) Prior Publication Data

US 2018/0273349 A1 Sep. 27, 2018

(30) Foreign Application Priority Data

Dec. 14, 2015 (EP) ..... 15199820

(51) Int. Cl.
*B66B 19/00* (2006.01)
*B66B 7/02* (2006.01)

(52) U.S. Cl.
CPC ..... *B66B 19/002* (2013.01); *B66B 7/024* (2013.01); *B66B 7/027* (2013.01); *B66B 19/00* (2013.01)

(58) Field of Classification Search
CPC ..... B66B 7/024; B66B 7/027; B66B 19/002
See application file for complete search history.

(56) References Cited

U.S. PATENT DOCUMENTS 3,851,736 A * 12/1974 Westlake ..... B66B 19/002 52/745.2
5,520,264 A * 5/1996 Korhonen ..... B66B 7/02 187/408

(Continued)

FOREIGN PATENT DOCUMENTS

CN 104334490 A 2/2015
CN 104340813 A 2/2015

(Continued)

*Primary Examiner* — Minh Truong
(74) *Attorney, Agent, or Firm* — William J. Clemens; Shumaker, Loop & Kendrick, LLP

(57) ABSTRACT

A method for erecting an elevator system in an elevator shaft of a building includes performing at least one lift process to adapt a usable lift height of the elevator system to an increasing height of the building. During the lift process, a drive platform, which supports an elevator drive machine and, via a flexible support, an elevator car and a counterweight, is lifted along at least one elevator car guide rail. Prior to the lift process, the at least one elevator car guide rail is elongated in the upwards direction above the drive platform and fixed to a shaft wall of the elevator shaft by at least one auxiliary support in the region of the elongation. After the lift process, the at least one auxiliary support, which then lies below the drive platform, is replaced by a final guide rail mounting which is designed differently than the auxiliary support.

12 Claims, 3 Drawing Sheets

(56) References Cited

U.S. PATENT DOCUMENTS

| | | | | |
|---|---|---|---|---|
| 6,672,013 | B1 * | 1/2004 | Glassey | B66B 19/002 187/406 |
| 9,834,415 | B2 * | 12/2017 | Hense | B66B 5/042 |
| 2005/0150728 | A1 * | 7/2005 | Van Der Meijden | B66B 19/002 187/411 |
| 2007/0137946 | A1 * | 6/2007 | Aulanko | B66B 19/002 187/404 |
| 2007/0256899 | A1 * | 11/2007 | Fanielle | B66B 19/005 187/408 |
| 2009/0120734 | A1 * | 5/2009 | Barneman | B66B 19/002 187/408 |
| 2009/0223751 | A1 * | 9/2009 | Peacock | B66B 19/00 187/414 |
| 2012/0291395 | A1 * | 11/2012 | Plathin | B66B 19/02 52/741.1 |
| 2015/0034425 | A1 | 2/2015 | Ratia et al. | |

FOREIGN PATENT DOCUMENTS

| | | | |
|---|---|---|---|
| FR | 2694279 | A1 | 2/1994 |
| JP | H06321456 | A | 11/1994 |

* cited by examiner

METHOD FOR ERECTING AN ELEVATOR SYSTEM, AND ELEVATOR SYSTEM WHICH CAN BE ADAPTED TO AN INCREASING BUILDING HEIGHT

FIELD

The invention relates to a method for erecting an elevator system in an elevator shaft of a building that is in its construction phase, in which method at least one lift process is carried out in order to adapt a usable lift height of the elevator system to an increasing height of the building, the lift process comprising lifting a drive platform with an elevator drive machine and an elevator car suspended from the drive platform by at least one support means, along at least one elevator car guide rail.

The invention further relates to an elevator system that is created according to this method.

Specifically, the invention relates to a method for erecting an elevator system that can be adapted to an increasing building height, with which elevator system the counterweight track is arranged on the same side of the elevator car as one of the elevator car guide rails, wherein this elevator car guide rail is fastened in the final state of the elevator system to a plurality of guide rail mountings surrounding the counterweight track.

BACKGROUND

FR 2 694 279 A1 discloses an elevator system that can be adapted to an increasing building height and is erected in a shell of a building that encloses an elevator shaft. The elevator system comprises a machine platform on which an elevator drive machine is mounted with a drive pulley. A support means that leads on one side to the elevator car and on the other side to a counterweight is led about this drive pulley. In order to increase the lift height of the elevator system, the machine platform can be lifted together with the elevator car in the vertical direction along the guide rails of the elevator car. The lifting is done with the aid of a hoist or a crane, wherein the required elongation of the support means is provided by supplying the support means elongation from a supply reel. The machine platform can be supported at predetermined positions via four telescopic arms in the shaft walls of the elevator shaft, through insertion of the telescopic arms into suitable recesses. On the side of the elevator car on which the counterweight is arranged, an elevator car guide rail and two counterweight guide rails are provided. These extend from the shaft bottom to over the retracted protective bottom.

The purpose of the invention disclosed in FR 2 694 279 A1 is to reduce the use of a construction crane by adapting the usable height of the elevator system from time to time to the increasing building height so that certain transports required during the construction phase of the building are already feasible with the elevator system. The solution set forth, however, is applicable only if the width of the counterweight is so small that the counterweight track thereof—as illustrated in the drawings of FR 2 694 279 A1—can be arranged between a front wall or a back wall of the elevator shaft and the counterweight-side elevator car guide rail with the fastening elements thereof. Otherwise, the aforementioned elevator car guide rail could not be fastened to the shaft wall adjacent thereto. Moreover, such a solution necessitates a support means arrangement with which the support means are led substantially from the center of the elevator car via the drive pulley to the counterweight, which is arranged at an offset with respect to the elevator car, which is only made possible by arranging the support means in a vertical plane lying oblique to the elevator car.

SUMMARY

The invention addresses the problem of setting forth a method for erecting an elevator system in an elevator shaft of a building, in which method a usable lift height of the elevator system can be adapted to an increasing height of the building, as well as to set forth an elevator system that has been produced according to this method, wherein both the method and the elevator system are free of the aforementioned disadvantages of the prior art. Specifically, the invention addresses the problem of setting forth such a method and an elevator system produced with such a method that make it possible to lead a drive platform with an elevator drive machine of the elevator system on the elevator car guide rails of the elevator system, wherein the counterweight track is arranged on a side of the elevator car on which one of the elevator car guide rails is also located, and wherein the above-mentioned limitations present in the prior art are avoided.

Solutions for such a method, for an elevator system that has been produced with such a corresponding method, and for an elevator system that can be adapted to an increasing building height are presented hereinbelow. In addition, advantageous supplemental or alternative further developments and embodiments are specified.

The solution of the problem lies in a method for erecting an elevator system in an elevator shaft of a building, in which method at least one lift process is carried out in order to adapt a usable lift height of the elevator system to an increasing height of the building, the lift process comprising lifting at least one drive platform that supports an elevator drive machine as well as—via flexible support means—an elevator car and a counterweight along at least one of the elevator car guide rails, wherein—before the lift process—the at least one elevator car guide rail is elongated in the upwards direction above the drive platform, and is fixed to a shaft wall of the elevator shaft in the region of this elongation by means of at least one auxiliary support, and wherein—after the lift process—the at least one auxiliary support, which then lies below the drive platform, is replaced by a final guide rail mounting that is differently designed than the auxiliary support.

In the present description and in the claims, the term "shaft wall" is to be understood to be any type of lateral boundary of the elevator shaft to which components of the elevator system can be fixed. In particular, with elevator shafts arranged next to one another, or with elevator shafts arranged on the outside of a building, shaft walls may be composed, for example, solely of steel beams.

The method according to the invention makes it possible for a drive platform to be lifted along the elevator car guide rail even when parts of the drive platform would, in the final embodiment thereof, collide with guide rail mountings arranged above the drive platform. This applies in particular to elevator systems with which the elevator car interacts with a counterweight that is arranged on the same side of the elevator car as one of the elevator car guide rails, and the horizontal cross-section thereof does not allow for the counterweight to be arranged in front of or behind—as seen in the depth direction of the elevator car—the laterally-arranged elevator car guide rail.

Another solution of the problem lies in an elevator system that has been produced with the above-mentioned method.

The term "resulting counterweight track" as used hereinbelow shall express that the already-usable counterweight track is elongated progressively upward by the mounting of additional guide rail mountings and fastening of the counterweight guide rails thereto. Also simply the term "counterweight track" is used, since the context makes it clear whether the already-usable or resulting part is meant.

Generally, an elevator system with which the counterweight track is arranged on the same side of the elevator car as one of the elevator car guide rails comprises a plurality of guide rail mountings each having at least two support elements protruding into the elevator shaft so as to be perpendicular to a shaft wall, as well as a cross-member, wherein the support elements and the cross-member of each guide rail mounting form a frame that lies in a horizontal plane and at least partially encloses the counterweight track. The guide rail mountings are then fixed so as to be stationary to a shaft wall of the elevator shaft. Provided between the individual guide rail mountings are vertical distances that are more or less regular according to the structural conditions. Then, a counterweight guide rail can be fastened to each of the two support elements of a guide rail mounting, and an elevator car guide rail can be fastened to the cross-member. With an elevator system having a liftable drive platform, the drive platform may be designed such that the drive platform would collide with such usual guide rail mountings in a lift process. Before a lift process, therefore, the at least one elevator car guide rail is elongated in the upwards direction above the drive platform, and is fixed temporarily to the counterweight-side shaft wall in the region of this elongation by means of at least one auxiliary support. Then, the at least one auxiliary support ensures on the one hand the stability of the elevator car guide rail that was newly mounted above the drive platform before the lift process, and is designed on the other hand so as not to hinder the lifting movement of the drive platform in a lift process, in contrast to a usual guide rail mounting. The temporary replacement of the usual guide rail mountings—by at least one auxiliary support—that takes place above the drive platform makes it possible to lead the drive platform and the elevator car during the lift process to the part of the elevator car guide rail that extends upward above the drive platform—and thus above the final guide rail mountings—before the lift process. It shall be understood that here a plurality of auxiliary supports that can be used again for another lift process after the respective dismantling thereof—i.e., further upward—may be used. Even after the elevator system has been completely erected, the auxiliary supports may be used for the next elevator system to be erected, so that the use of such auxiliary supports does not entail significantly higher material costs.

In one possible embodiment variant of the method according to the invention, the auxiliary support is designed so as to not form a movement obstacle in the lift process for the entire drive platform when in the installed state.

The term "entire drive platform" is to be understood here to mean the drive platform with all of the components installed thereon, in particular, with the support means rollers mounted onto the drive platform and with the drive pulley.

With an elevator system having a liftable drive platform that is designed so that the drive platform would collide with usual guide rail mountings arranged above the drive platform in a lift process, this embodiment variant opens up the very possibility of a lift process for adapting the usable lift height, i.e., lifting of the drive platform along the at least one elevator car guide rail.

In another possible embodiment variant of the method, the counterweight is arranged along a vertical counterweight track that is arranged on the same side of the elevator car as the elevator car guide rail that is fixed to at least the aforementioned guide rail mounting, wherein the support means is passed between the elevator car and the counterweight via a drive pulley of the elevator drive machine and via at least one deflecting roller supported on the drive platform, and wherein at least the deflecting roller or the drive pulley is arranged so as to protrude into the counterweight track.

This, in contrast to the prior art, makes it possible to use the method for adapting the usable lift height even with an elevator system with which the elevator car interacts with a counterweight that is arranged on the same side of the elevator car as one of the elevator car guide rails, wherein the counterweight has a horizontal cross-section that does not allow for the counterweight to be arranged in front of or behind—as seen in the depth direction of the elevator car—the laterally-arranged elevator car guide rail.

In another possible embodiment variant of the method, the final guide rail mounting has a first support element and a second support element that are fixed to the shaft wall before or after the lift process at approximately the same height on opposite sides of a resulting counterweight track, and that protrude into the elevator shaft. To finish the final guide rail mounting, a cross-member that does not extend through the resulting counterweight track is integrated into the guide rail mounting, by connection of the cross-member at one end thereof to an end of the first support element that protrudes into the elevator shaft and at the other end thereof to an end of the second support element that protrudes into the elevator shaft.

This makes it possible for the elevator car guide rail to be connected after the lift process to the then-mounted cross-member so that, via the cross-member, there is an indirect connection between the elevator car guide rail and the two support elements, and thus between the elevator car guide rail and the shaft wall. The final guide rail mounting composed of the support elements and the cross-member then encloses the counterweight track, together with the shaft wall, wherein the final guide rail mounting allows for unencumbered vertical travel of the counterweight along the counterweight track, in contrast to the temporarily-mounted auxiliary support. Such a final guide rail mounting ensures stable fixation of an elevator car guide rail arranged on the side of the counterweight track.

In another possible embodiment variant of the method, the at least one auxiliary support is fixed directly or indirectly to the shaft wall above the drive platform before the lift process in such a manner as to at least partially extend through the resulting counterweight track and therein not hinder the lift process of the drive platform, and—after the lift process—the at least one auxiliary support, which then lies below the drive platform, is dismantled and replaced by a final guide rail mounting, the components of which are arranged outside of the resulting counterweight track but at least partially inside of the vertical projection of the entire drive platform.

Use of a method having this method step makes it simple to solve the present problem for many embodiments of elevator systems having with a usable lift height that can be adapted.

In another possible embodiment variant of the method, two support elements allocated to a guide rail mounting are fixed to the shaft wall above the drive platform before a lift process, wherein a resulting counterweight track extends between these support elements, and the at least one auxiliary support is temporarily fixed directly or indirectly to the shaft wall before the lift process, where the auxiliary support extends at least partially through the resulting counterweight track, and the elevator car guide rail is elongated upward to the auxiliary support and fastened temporarily to the auxiliary support in the region of the elongation thereof before the lift process, and—after the lift process—a cross-member that does not extend through the resulting counterweight track is integrated into the final guide rail mounting, the elevator car guide rail is fastened to this cross-member, and the auxiliary support is dismantled.

The mounting of the support elements of the final guide rail mountings together with the associated auxiliary supports is easier to perform before a lift process and above the drive platform, due to the improved accessibility, than after the lift process and under the drive platform. Moreover, the jointly possible alignment of the support elements and the auxiliary supports saves assembly time.

In another possible embodiment variant of the method, the lift process comprises lifting at least the drive platform with the elevator drive machine along the elevator car guide rail, wherein the drive platform is guided on a part of the elevator car guide rail that is temporarily mounted onto the auxiliary support. Here, it shall be understood that there generally is at least one more elevator car guide rail present in addition to the elevator car guide rail that is fastened to the auxiliary support before and during the lift process and to the final guide rail mounting after the lift process. Such an additional elevator car guide rail may be fastened, in particular, to that shaft wall that lies opposite the shaft wall on which the counterweight track is arranged. It is also advantageous if, at least in the lift process, both the drive platform and the elevator car or the counterweight are lifted and then guided by the at least one more elevator car guide rail, which is temporarily mounted on at least one auxiliary support. For example, in the lift process, the elevator car may be coupled to the drive platform and lifted together therewith. Advantageously, the counterweight remains supported in the lowermost position thereof during the lift process. The elongation of the support means that is required in this process is achieved by feeding in an appropriate length of support means at the counterweight-side fixture of the support means, wherein same is rolled out from a support means reserve unit. It shall be readily understood that the fixation of the support means on the counterweight-side fixture may be released prior to this process, and restored after the lift process has been completed. The aforementioned support means reserve unit may be, for example, mounted onto a shaft bottom.

In another possible embodiment variant of the method, the first support element and the second support element of the final guide rail mounting are mounted at least approximately at the same height on opposite sides of the counterweight track in the elevator shaft, wherein a first counterweight guide rail is connected to the first support element and a second counterweight guide rail is connected to the second support element, and wherein a counterweight suspended from the drive platform via the support means, along with the elevator car, is guided on the first counterweight guide rail and the second counterweight guide rail.

In this embodiment, the counterweight guide rails may be mounted onto the support elements of the guide rail mountings already before the lift process, which correspondingly remain mounted even after the lift process.

In another possible embodiment variant of the method, the auxiliary support is temporarily fastened directly or indirectly to the shaft wall so as to extend from the shaft wall of the elevator shaft substantially horizontally through a middle region of the resulting counterweight track into the elevator shaft.

This is advantageous in making available two approximately equally wide spaces within the counterweight track, on both sides of the auxiliary support, within each of which spaces support means can be guided to the counterweight. When the drive platform is lifted, greater oscillations of the support means and contact of the support means with one another can be prevented by the separated spaces.

In another possible embodiment variant of the method, at least the elongations of the elevator car guide rails that are required above the drive platform and the auxiliary supports being used to temporarily fix the elongation of the elevator car guide rail arranged on the counterweight side of the elevator car are mounted from a mounting platform that is temporarily installed above the drive platform and can be lifted and lowered.

This is especially advantageous in that the aforementioned components can be mounted without exposing the technicians to the risk of a crash.

In another possible embodiment variant of the method, the support means are elongated during the lift process, wherein the elongations of the support means are complemented or unrolled from a support means reserve unit in accordance with the additional length needed due to the new usable lift height.

This method step obviates the need to replace the support means after every adaptation of the usable lift height of the elevator system.

In another possible embodiment variant of the method, the guide rail mountings lying below the drive platform are brought, after the lift process, into the final state thereof through attachment of the cross-members thereof, the cross-members are connected to the elevator car guide rail arranged on the counterweight side of the elevator car, and the auxiliary supports, which also lie below the drive platform after the lift process, are dismantled.

In another possible embodiment variant of the method, the attachment of the cross-members, the connecting of the cross-members to the elevator car guide rail arranged on the counterweight side of the elevator car, and the dismantling of the auxiliary supports—after the lift process has been completed, or after restarting of the elevator system—are carried out by a technician operating from the top of the elevator car suspended from the drive platform, which can be moved vertically with control.

This solves the problem of being able to carry out the aforementioned method steps in a safe manner below the drive platform.

The elevator system thus enables vertical transport of passengers, goods, and other materials already during an early construction phase. Herein, the installation may be performed according to the progress of construction in the elevator shaft, which is being progressively erected in height. This enables rapid, reliable, and safe vertical transport in all weather conditions, even at an early point in time. In particular, the elevator system may be used herein already from the beginning of construction up to the permanent installation. This makes it possible, inter alia, for the floors to be completed, rented, and occupied to a certain extent from the bottom upward, even when the building is only partially complete. Especially with large high-rise projects for private and/or commercial use, this provides considerable improvement in terms of economy and significantly more advantageous initial reference period.

DESCRIPTION OF THE DRAWINGS

Embodiments of the invention shall be described in further detail in the description below with reference to the accompanying drawings. In the drawings.

DETAILED DESCRIPTION

Figure 1:
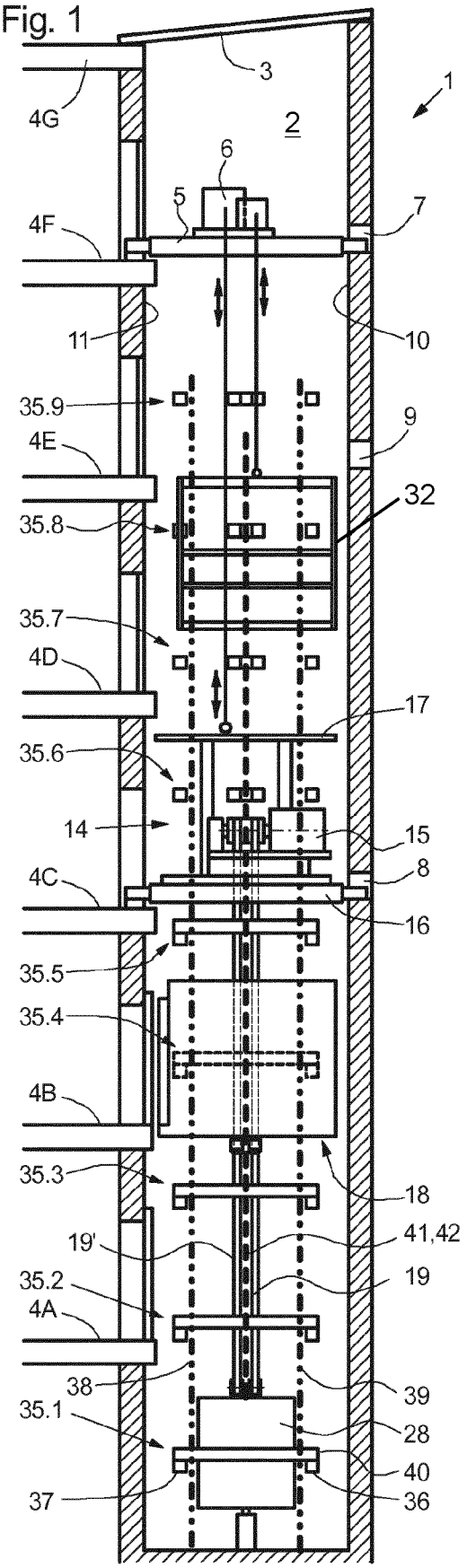
FIG. 1 illustrates an elevator system that can be adapted to an increasing building height in an elevator shaft of a building, in a right side schematic representation corresponding to one embodiment of the invention.
Figure 2:
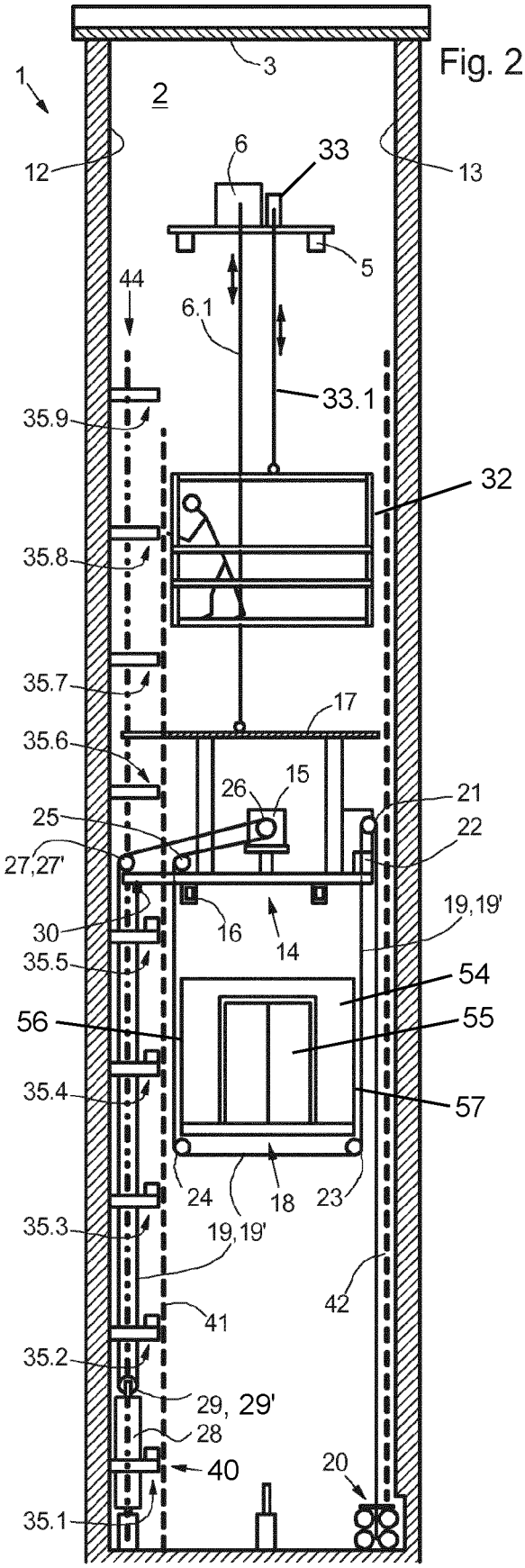
FIG. 2 illustrates the elevator system illustrated in FIG. 1, in a schematic representation from a front side.

FIG. 1 illustrates an elevator system 1 that can be adapted to an increasing building height in an elevator shaft 2 of a building, in a right side schematic representation corresponding to one embodiment of the invention. FIG. 2 illustrates the elevator system 1 depicted in FIG. 1, from the front side. The elevator shaft comprises two shaft walls 10, 11 that are visible in FIG. 1, and two shaft walls 12, 13 that are visible in FIG. 2.

An elevator system 1 is adapted to a newly-achieved, greater height of a building currently being constructed substantially in that a drive platform 14 which has been temporarily fixed in the elevator shaft 2 and from which an elevator car 18 and a counterweight 28 have been suspended so as to enable lifting and lowering by means of support means (19, 19') is lifted over the course of a lift process to a higher building level and again temporarily fixed there, wherein the effective length of the support means is adapted during the lift process to the new lift height, and in that the elevator system is subsequently put back into operation. When the intended maximum height of the elevator system 1 has been achieved, the drive platform 14 may—if provided—be permanently fixed as an engine room bottom.

FIG. 1 illustrates, by way of example, floors 4A to 4G/floor bottoms 4A to 4G pertaining thereto. In fact, a plurality of such floors may arise during the construction of the building. The floor 4G, which is depicted here as temporarily the uppermost floor and optionally is only partly built serves here to support a canopy 3 that protects the elevator shaft 2 from the effects of weather and possibly falling objects.

The elevator system 1 shall be explained further hereinbelow, with reference to FIG. 1 and FIG. 2. The elevator system 1 comprises the drive platform 14, which includes an elevator drive machine 15, a support device 16 for supporting the drive platform 14 in the elevator shaft, and a canopy 17. The drive platform 14, with the elevator drive machine 15, is herein supported on the building via the support device 16, wherein the support device 16 is supported on one side in the niche 8 of the shaft wall 10 and on the other side on the floor bottom 4C. The canopy 17 serves, inter alia, to protect against falling objects.

The elevator system 1 furthermore comprises an elevator car 18 and a counterweight 28, which are suspended from the drive platform 14 via support means 19, 19' and can be moved back and forth via these support means through the elevator drive machine 15 along two elevator car guide rails 41, 42, or two counterweight guide rails 38, 39. To simplify the representation, FIGS. 1 and 2 depict the elevator car guide rails 41, 42 through dashed lines, and the counterweight guide rails 38, 39 through dash-dot lines. The support means 19, 19' are led vertically upward from a support means reserve unit 20 to guide pulleys 21 that are mounted on the drive platform 14. From these guide pulleys 21, the support means 19, 19' extend vertically downward through a first support means-fixing apparatus 22 installed on the drive platform to car support rollers 23, 24 connected to the elevator car 18. The support means 19, 19' are passed through under the elevator car 18 via the car support rollers 23, 24. Then, the support means 19, 19' extend vertically upwards and run around deflecting rollers 25, a drive pulley 26 of the elevator drive machine 15, and deflecting rollers 27, 27'. The support means 19, 19' are deflected to the counterweight track 44 by means of the deflecting rollers 27, 27', and guided vertically to counterweight support rollers 29, 29' connected to the counterweight 28, run around same, and extend eventually to a second support means-fixing apparatus 30, where same are connected to the drive platform 14.

A lifting device 6 is arranged in the region of the upper end of the elevator shaft, at the level of the floor 4F, the lifting device having been lifted there by means of another lifting device or by means of a construction crane before a lift process. The lifting device 6 is used to lift the entire drive platform 14 with the elevator car 18 suspended therefrom and the counterweight 28 to a new level adapted to the current building height via a pulling means 6.1 in a lift process. It is mounted on a support frame 5 that is supported in a niche 7 of the shaft wall 10 and on the floor bottom 4F. Still further niches 8, 9 that can be used to support system components are provided on the shaft wall 10 in this embodiment. Instead of the niches 7, 8, 9, however, other possible forms of support would also be conceivable, e.g., support elements fastened to the shaft wall 10. Furthermore, instead of the support on the floor bottoms 4A to 4F, it would also be possible to implement support on support elements that are fixed to the shaft wall 11 that is opposite the shaft wall 10.

In the above-described suspension of the elevator car 18 and the counterweight 28 from the drive platform 14, the length of the support means 19, 19' that can be used for the operational lifting of the elevator car 18 can be elongated from the support means reserve unit 20, if this is required over the course of a lift process carried out to adapt the usable lift height. To this end, the support means 19, 19' may be clamped or released by means of the first support means-fixing apparatus 22. Before a lift process, for example, the counterweight 28 is set in the lower region of the elevator shaft 2, the elevator car 18 is fixed to the drive platform 14, the brake of the elevator drive machine 15 is released, and the support means-fixing apparatus 22 is released. If, in the subsequent lift process, the drive platform 14 is being lifted with the elevator car 18 by the lifting device 6, the support means elongations required therefor are pulled out from the support means reserve unit 20. There are, however, also other manners of suspension of the elevator car 18 and the counterweight 28, such as other manners of tracking the support means 19, 19'.

Before a lift process in which the drive platform 14 is lifted by the lifting device 6, the lifting device 6 must be positioned and fixed sufficiently high—for example, three floors above the drive platform 14, for example, by means of another lifting device or a construction crane. Then, the drive platform 14 can be lifted to a desired position in the elevator shaft 2 and supported there. The drive platform 14 is located then, for example, two floors above the floor 4C, at which same was positioned in the initial state depicted in FIGS. 1 and 2. Thus, after the lift process, the drive platform 14 is located on the floor 4E, wherein the drive platform is supported on the one side on the floor bottom 4E and on the other side in the niche 9 of the shaft wall 10. In a lift process, however, a lift by a plurality of floors may also be performed if construction has progressed to a corresponding amount. It shall also be understood that in a lift process, the lifting of the drive platform 14 is not necessarily limited to an integer multiple of the height of one floor.

It can be seen from FIGS. 1 and 2 that a mounting platform 32, which can be lifted and lowered via a pulling means 33.1 by means of a hoist 33 that can be controlled from the mounting platform is installed temporarily between the canopy of the drive platform 14 and the support frame 5 of the lifting device 6. This mounting platform 32 is used mainly as a work platform from which the elongations of the counterweight guide rails 38, 39 and the elevator car guide rails 41, 42 that are required above the drive platform 14 and auxiliary supports 43 that are being used to temporarily fix the elongation of the elevator car guide rail 41 arranged on the counterweight side of the elevator car are mounted before each lift process. The purpose and function of these auxiliary supports 43 shall be described further hereinbelow.

Before and after a lift process, mounting steps are carried out in order to adjust or elongate the guide rails of the counterweight 28 and the guide rails of the elevator car 18, and therewith the liftable drive platform 14. These mounting steps shall be described in further detail hereinbelow, also with reference to FIG. 3 to FIG. 6.

The elevator system 1 has, in the operational state, a plurality of guide rail mountings 35.1 to 35.9 that are attached in this embodiment to the shaft wall 12, and that, in the final state, are used both to fix two counterweight guide rails 38, 39 and to fix the elevator car guide rail 41 arranged on the counterweight side of the elevator car 18.

Figure 3:
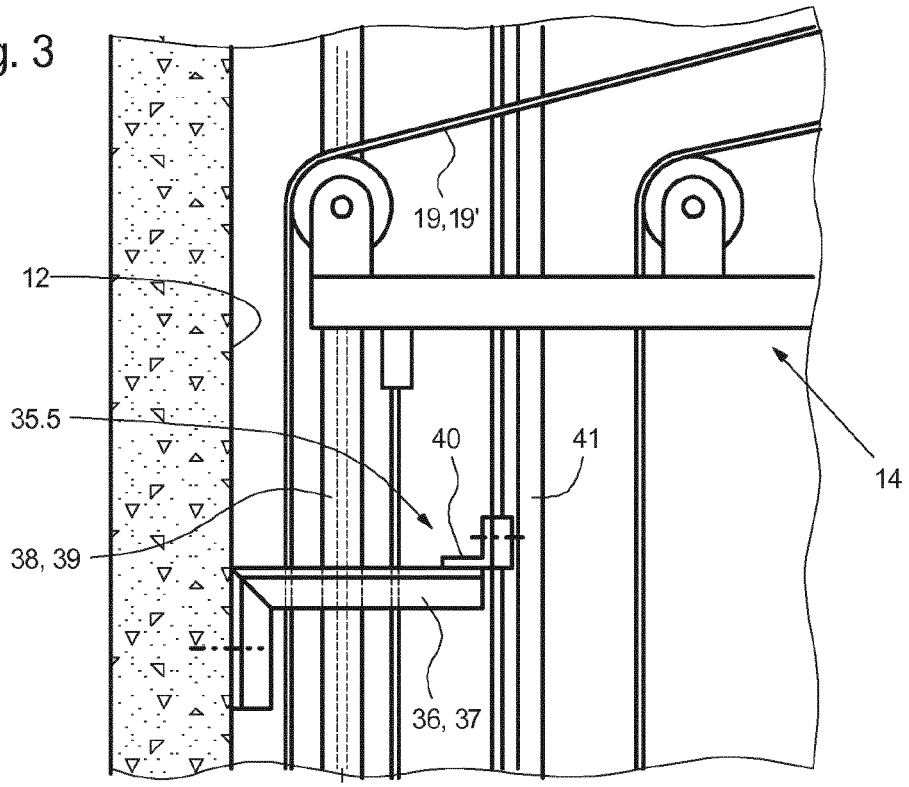
FIG. 3 illustrates a detail view of the elevator system before the lift process that is required for the adaptation to the building height, in front view.

FIG. 3 (front view) and FIG. 4 (plan view) depict a final guide rail mounting 35.5 arranged below the drive platform 14, in connection with parts of the drive platform 14 that protrude into the counterweight track 44. The final guide rail mounting 35.5 has support elements 36, 37, wherein the support element 36 is referred to here as a first support element 36 and the support element 37 is referred to here as a second support element 37. The support elements 36, 37 are configured, for example, as L-brackets, and are fastened to the shaft wall 12 of the building. A first counterweight guide rail 38 is fastened to the first support element 36. A second counterweight guide rail 39 is fastened to the second support element 37. In the final state, the guide rail mounting 35.5 also has a cross-member 40 which is connected to the support elements 36, 37, and to which the elevator car guide rail 41 arranged on the counterweight side of the elevator car 18 is fastened.

Figure 4:
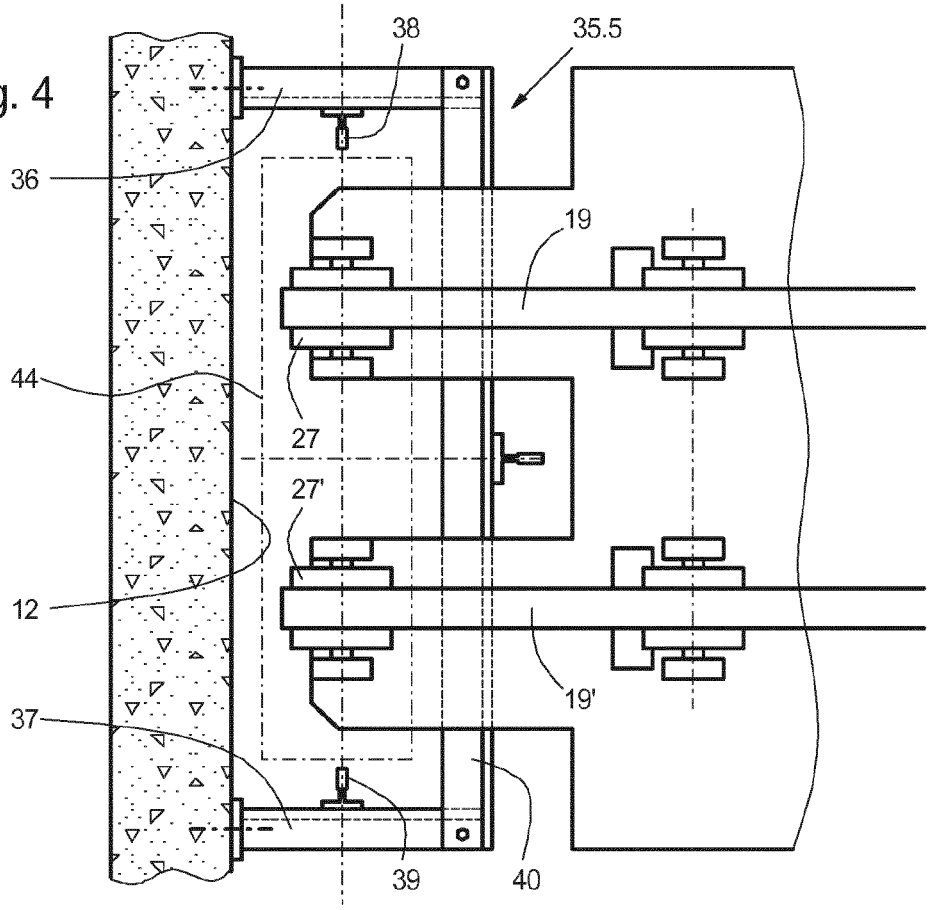
FIG. 4 illustrates the detail view according to FIG. 3, in plan view.

FIGS. 3 and 4 show that the drive platform 14 comprises components that protrude into the counterweight track 44—in particular, the deflecting rollers 27, 27' with the bearings thereof and the parts of the drive platform 14 that support same—and that, with an elevator system 1 with an elevator car guide rail 41 arranged on the counterweight side of the elevator car 18, are used to guide the support means 19, 19' so as to then extend vertically, i.e., parallel to the counterweight track 44, to the counterweight support roller 29 (not visible in FIGS. 3 and 4). Since these components protruding into the counterweight track 44—which may also be present in the form of a drive pulley of the drive machine in another embodiment of the elevator system—are not avoidable, it necessarily happens that the drive platform 14 cannot be lifted past the final guide rail mountings 35.1-35.9 with the mounted cross-member 40.

The solution of this problem lies in that before the lift process, the counterweight-side elevator car guide rail 41 is elongated in the upwards direction above the drive platform 14 and fixed to a shaft wall 12 of the elevator shaft 2 in the region of this elongation by means of at least one auxiliary support 43, and in that after the lift process, the at least one auxiliary support 43, which then lies below the drive platform 14, is replaced by a final guide rail mounting 35.1-35.9 that is designed differently than the auxiliary support.

The final guide rail mountings 35.1-35.5 depicted below the drive platform 14 in FIG. 1 and FIG. 2 are thus only mounted or brought into the final state thereof by attachment of the cross-members 40 after the drive platform 14 has been guided past same over the course of a lift process. Preferably, this is carried out after the lift process has been completed, or after restarting of the elevator system by a technician operating from the top of the elevator car 18, which can be displaced so as to be vertically controllable.

The non-final guide rail mountings 35.6-35.9 depicted above the drive platform 14 in FIG. 1 and FIG. 2 may advantageously—but need not necessarily—already be installed before a lift process, together with the aforementioned auxiliary supports 43 from the previously-described mounting platform 32. These non-final guide rail mountings 35.6-35.9 differ from the final guide rail mountings 35.1-35.5 in that the cross-members 40 thereof have not yet been mounted.

Figure 5:
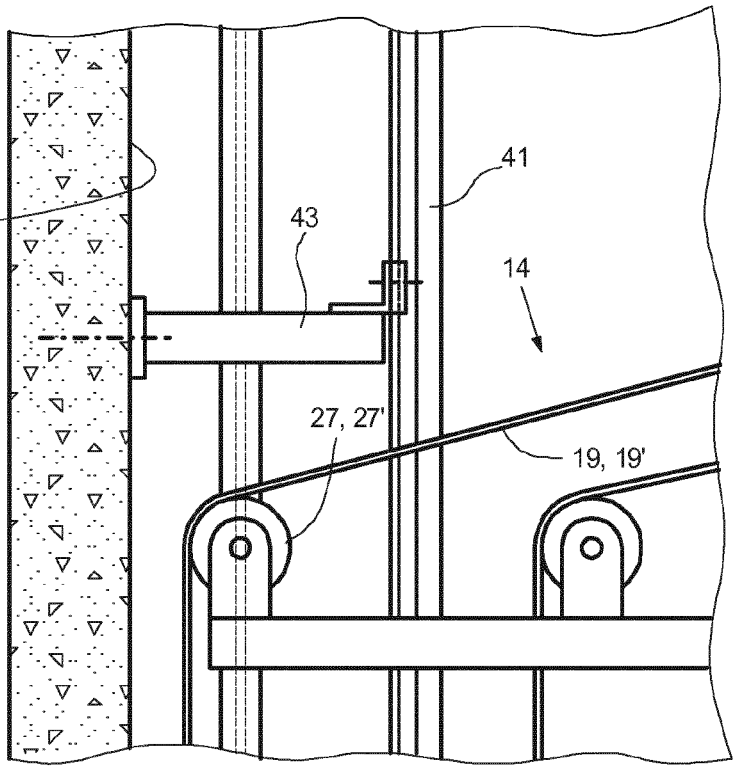
FIG. 5 illustrates a detail view of the elevator system before the lift process that is required for the adaptation to the building height, in front view.
Figure 6:
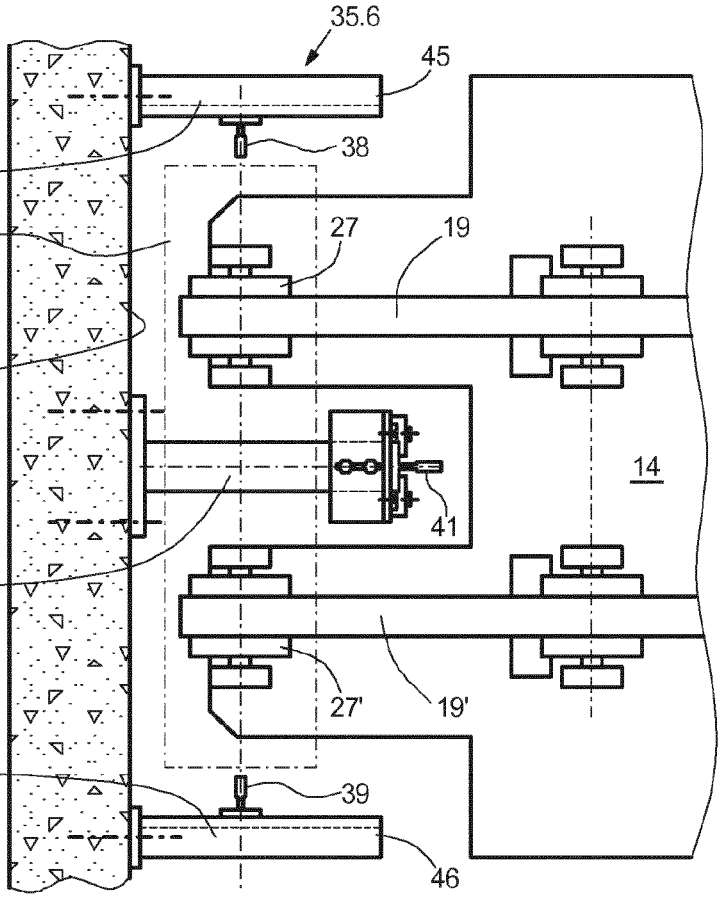
FIG. 6 illustrates the detail view according to FIG. 5, in plan view.

FIG. 5 (front view) and 6 (plan view) illustrates a situation occurring before a lift process, of the drive platform 14 with the deflecting rollers 27, 27' thereof protruding into the counterweight track 44, such as is described in connection with FIGS. 3 and 4. Depicted above the drive platform 14 is one of a plurality of auxiliary supports 43 that are temporarily fastened above the drive platform 14 to the shaft wall 12 and are designed so as to be able to protrude between the aforementioned deflecting rollers 27 and 27' to the counterweight-side elevator car guide rail 41 into the drive platform without hindering the upward movement of the drive platform 14 in the lift process. Therein, the auxiliary supports 43 must be configured so as to be sufficiently stable in order to be able to adequately fix the elevator car guide rail 41 at least during the lift process. Moreover, FIG. 6 depicts one (35.6) of a plurality of guide rail mountings 35.6-35.9 that are first partially mounted above the drive platform 14, which guide rail mountings first comprise the support elements 36, 37 fastened to the shaft wall 12. These support elements are covered by the auxiliary support 43 and therefore are not visible in the associated front view (FIG. 5). Advantageously, the elongations of the counterweight guide rails 38, 39 have already been fixed to these support elements 36, 37 before the lift process. Both the support elements 36, 37 of the guide rail mounting 35.6-35.9 and at least one auxiliary support 43 are preferably mounted from the liftable and lowerable mounting platform 32. If one of the auxiliary supports is to be installed in the region of the drive platform 14 so as not to be reachable from the mounting platform 32, then this can be done from the drive platform 14. The auxiliary supports 43 are arranged so as to be approximately centered between the support element parts 36, 37 of the guide rail mountings 35. The exact position of the auxiliary support 43 arises from the predetermined position of the elevator car guide rail 41. Via the auxiliary supports 43, the elongation of the counterweight-side elevator car guide rail 41 extending upwards from the drive platform 14 is connected to the shaft wall 12. Another elevator car guide rail 42 that is schematically depicted by the dashed line 42 in FIGS. 1 and 2 is also elongated upward before the lift process. Both this elongation and the fastening of the second elevator car guide rail 42 to the shaft wall 13 may also be performed from the liftable and lowerable mounting platform 32.

To carry out the lift process, the drive platform 14 is lifted with the elevator car temporarily connected to the latter by the lifting device 6 via the pulling means 6.1. Herein, additional support means is also simultaneously released from the support means reserve unit 20. During the lifting, the drive platform 14 is guided on the elevator car guide rails 41, 42, which have been elongated before the lift process and on which the elevator car 18 is also guided. In particular, the deflecting rollers 27, 27' and the components of the drive platform 14 that support these deflecting rollers protrude herein into the counterweight track 44, which extends upward between the support elements 36, 37 of all of the guide rail mountings 35.1 to 35.9. The deflecting rollers 27, 27' can be prevented from colliding with the guide rail mountings 35.5 to 35.9 in that the cross-members 40 are not yet mounted onto the aforementioned guide rail mountings, and the auxiliary supports 43 fixing the counterweight-side elevator car guide rail 41 are designed and positioned so as to allow for being guided through between the deflecting rollers 27 or the components of the drive platform 14 that support same. After the drive platform 14 has been lifted far enough upward and fixed, and the elevator system has been made operational again, the cross-members 40 are mounted from the top of the vertically displaceable elevator car 18, on the one hand at the end 45 of the first support element 36, and on the other hand at the end 46 of the second support element 37 of the respectively associated guide rail mountings now lying below the drive platform, and are therewith integrated thereinto so that now the guide rail mountings 35.1-35.8 are now in the final state. Then, the elevator car guide rail 41 is definitively fixed to the cross-members and the auxiliary supports 43 are dismantled.

In this embodiment, the drive platform 14 is supported at the height of the floor 4E after the lift process has been carried out. The support device 16 of the drive platform 14 may have extendable and retractable arms therefor. With further construction progress result in additional floors of height, the canopy 3 is fitted accordingly further upward. Then, the lifting device 6 is moved further upwards, too. Then, another lift process can be carried out for the drive platform 14. When the building has been finished, it would also possible for the drive platform 14 to be used directly in order to form a sort of engine room bottom. There are also, however, other conceivable solutions with which the drive platform 14 is removed completely or partially.

In this embodiment, an elevator car door 55 is located on the front side 54 of the elevator car 18. The counterweight track 44 is located on the doorless lateral side 56 of the elevator car 18, along which the support means 19, 19' are also guided. Also provided is another doorless lateral side 57 which faces away from the doorless lateral side 56 and along which the support means 19, 19' are also guided. The back side, facing away from the front side 54, is also available in this embodiment for installation of an elevator car door there.

In this embodiment, the elevator car guide rail 41 is connected to the cross-member 40 formed as an angle profile. Other kinds of fastening are also conceivable, however. Furthermore, the support elements 36, 37 may also be connected indirectly to the shaft wall 12. It is also conceivable to provide a support construction to which elements in the elevator shaft 2 can be fastened. A supporting shaft wall 12 is then optionally not necessary.

The invention is not limited to the embodiment described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for erecting an elevator system in an elevator shaft of a building including performing at least one lift process to adapt a usable lift height of the elevator system to an increasing height of the building, the lift process including lifting a drive platform along at least one elevator car guide rail, the drive platform supporting an elevator drive machine and, via a flexible support means, an elevator car and a counterweight, the method comprising the steps of:

before performing the lift process, elongating the at least one elevator car guide rail in an upwards direction above the drive platform and fixing the elongation of the at least one guide rail to a shaft wall of the elevator shaft by at least one auxiliary support; and after performing the lift process, replacing the at least one auxiliary support, which then lies below the drive platform, by a final guide rail mounting that is different than the at least one auxiliary support; wherein the final guide rail mounting has a first support element and a second support element that are fixed to the shaft wall before or after the lift process is performed at approximately a same height on opposite sides of a counterweight track and that protrude into the elevator shaft, and after the lift process is performed, connecting a cross-member that does not extend through the counterweight track at one end thereof to an end of the first support element that protrudes into the elevator shaft and at another end thereof to an end of the second support element that protrudes into the elevator shaft.

2. The method according to claim 1 wherein the at least one auxiliary support is not a movement obstacle for movement of the drive platform during the lift process when the at least one auxiliary support has fixed the elongation to the shaft wall.

3. The method according to claim 1 including moving the counterweight along the counterweight track that is arranged on a same side of the elevator car as the at least one elevator car guide rail, the final guide rail mounting fixing the at least one elevator guide rail to the shaft wall, and guiding the support means between the elevator car and the counterweight via a drive pulley of the elevator drive machine and via at least one deflecting roller supported on the drive platform, wherein the at least one deflecting roller or the drive pulley protrudes into the counterweight track.

4. The method according to claim 1 including fixing the at least one auxiliary support to the shaft wall above the drive platform prior to performing the lift process so as to extend at least partially through the counterweight track without hindering performing the lift process, and after performing the lift process, dismantling the at least one auxiliary support and replacing with the final guide rail mounting, the components of the final guide rail mounting being arranged outside of the counterweight track but at least partially inside a vertical projection of the drive platform.

5. The method according to claim 1 including the steps of:

before performing the lift process, fixing the first support element and the second support element allocated to the final guide rail mounting to the shaft wall above the drive platform, wherein the counterweight track extends between the support elements;

before performing the lift process, temporarily fixing the at least one auxiliary support directly or indirectly to the shaft wall, wherein the auxiliary support extends at least partially through the counterweight track;

before performing the lift process, elongating the elevator car guide rail upwardly to the auxiliary support and fastening the elongation temporarily to the at least one auxiliary support; and after performing the lift process, integrating the cross-member that does not extend through the counterweight track into the final guide rail mounting, fastening the at least one elevator car guide rail to the cross-member, and dismantling the at least one auxiliary support.

6. The method according to claim 1 wherein the lift process includes lifting the drive platform with the elevator drive machine along the at least one elevator car guide rail, wherein the drive platform is guided on a part of the at least one elevator car guide rail that is temporarily mounted onto the at least one auxiliary support.

7. The method according to claim 1 including connecting a first counterweight guide rail to the first support element and connecting a second counterweight guide rail to the second support element, and wherein the counterweight suspended from the drive platform via the support means is guided on the first and second counterweight guide rails.

8. The method according to claim 1 wherein the at least one auxiliary support is temporarily fastened directly or indirectly to the shaft wall of the elevator shaft so as to extend out from the shaft wall substantially horizontally through a middle region of the counterweight track into the elevator shaft.

9. The method according to claim 1 including mounting the elongation of the at least one elevator car guide rail and the at least one auxiliary support from a mounting platform that is temporarily installed above the drive platform and can be lifted and lowered in the elevator shaft.

10. The method according to claim 1 including, during performing the lift process, elongating the support means from a support means reserve unit according to an additional length needed.

11. The method according to claim 1 including after performing the lift process bringing a guide rail mounting lying below the drive platform into a final state to form the final guide rail mounting by attaching the cross-member thereto, connecting the cross-member to the at least one elevator car guide rail that is arranged on a counterweight side of the elevator car, and dismantling the at least one auxiliary support that also lies below the drive platform.

12. The method according to claim 11 including performing the attaching of the cross-member, the connecting of the cross-member, and the dismantling of the at least one auxiliary support from a top of the elevator car.

* * * * *